US007329173B2

(12) United States Patent
Song

(10) Patent No.: US 7,329,173 B2
(45) Date of Patent: Feb. 12, 2008

(54) TOOL GRINDING MACHINE

(75) Inventor: Yeo-Ching Song, No. 29, Lane 116, Yenping N. Rd., Sec. 6, Shihlin Dist., Taipei City (TW)

(73) Assignees: Yeo-Ching Song, Taipei (TW); Ting-Tsai Hsu, Taipei (TW)

( * ) Notice: Subject to any disclaimer, the term of this patent is extended or adjusted under 35 U.S.C. 154(b) by 197 days.

(21) Appl. No.: 11/237,701

(22) Filed: Sep. 29, 2005

(65) Prior Publication Data

US 2007/0072518 A1 Mar. 29, 2007

(51) Int. Cl.
*B24B 7/02* (2006.01)

(52) U.S. Cl. ..... 451/178; 451/48; 451/199; 451/212; 451/272

(58) Field of Classification Search ..... 76/108.1, 76/108.2, 108.4, 108.6; 409/66; 451/11, 451/14, 15, 48, 178, 199, 212, 272, 305, 451/314, 320

See application file for complete search history.

(56) References Cited

U.S. PATENT DOCUMENTS

| | | | | | |
|---|---|---|---|---|---|
| 2,421,358 | A | * | 5/1947 | Sneva | 451/374 |
| 2,556,073 | A | * | 6/1951 | Dixon | 451/214 |
| 3,073,076 | A | * | 1/1963 | French | 451/273 |
| 3,584,420 | A | * | 6/1971 | Southland | 451/216 |
| 3,656,264 | A | * | 4/1972 | Mackey et al. | 451/48 |
| 3,680,263 | A | * | 8/1972 | Johnson | 451/23 |
| 4,489,523 | A | * | 12/1984 | Webster | 451/5 |
| 5,184,431 | A | * | 2/1993 | Combrowski et al. | 451/375 |
| 5,649,853 | A | * | 7/1997 | Kuo | 451/178 |

* cited by examiner

*Primary Examiner*—Timothy V. Eley
(74) *Attorney, Agent, or Firm*—Rosenberg, Klein & Lee

(57) ABSTRACT

A grinding machine, which includes a grinding wheel rotatable by a motor, a first slide movable in X-axis direction, a second slide supported on the first slide and movable in Y-direction, a bracket supported on the second slide and turnable about Y-axis, a tool holder supported on the bracket for holding the workpiece for grinding by the grinding wheel, and a driving mechanism for rotating and reciprocating the tool holder.

4 Claims, 9 Drawing Sheets

TOOL GRINDING MACHINE

BACKGROUND OF THE INVENTION

1. Field of the Invention

The present invention relates to grinding machines and more particularly, to a grinding machine for grinding tool bits and milling cutters.

2. Description of the Related Art

Various grinding machines are known for grinding milling cutters and tool bits. Because different milling cutters and tool bits have different cutting edges and may be made of different materials of different hardness, it requires a special skill to grind different milling cutters and tool bits with conventional grinding machines. It is difficult to accurately and efficiently grind different milling cutters and tool bits with conventional grinding machines simply based on experience.

SUMMARY OF THE INVENTION

The present invention has been accomplished under the circumstances in view. It is the main object of the present invention to provide a grinding machine, which can conveniently be adjusted to fit the angle of the cutting edge of the workpiece so that the cutting edge of the workpiece can be ground accurately and efficiently. According to one aspect of the present invention, the grinding machine comprises a grinding wheel rotatable by a motor, a first slide movable by a first guide screw in X-axis direction, a second slide supported on the first slide and movable by a second guide screw in Y-direction, a bracket supported on the second slide and turnable about Y-axis, a tool holder supported on the bracket for holding the workpiece for grinding by the grinding wheel, and a driving mechanism for rotating and reciprocating the tool holder. According to another aspect of the present invention, the grinding machine further comprises an adjustment block mounted on the first slide, the adjustment block having an axial hole, an inner thread provided inside the axial hole for engagement with the first guide screw, and an adjustment hole axially joining the axial hole at an angle, a spring member connected between the adjustment block and the first slide to hold the adjustment block in an engagement position where the inner thread is kept meshed with the first guide screw to prohibit movement of the first slide relative to the first guide screw when the first guide screw stands still, and a handle fastened to the adjustment block for pulling by hand to move the adjustment hole into a parallel position relative to the first guide screw where the inner thread is disengaged from the first guide screw for allowing quick position adjustment of the first slide relative to the first guide screw.

DETAILED DESCRIPTION OF THE PREFERRED EMBODIMENT

Figure 1:
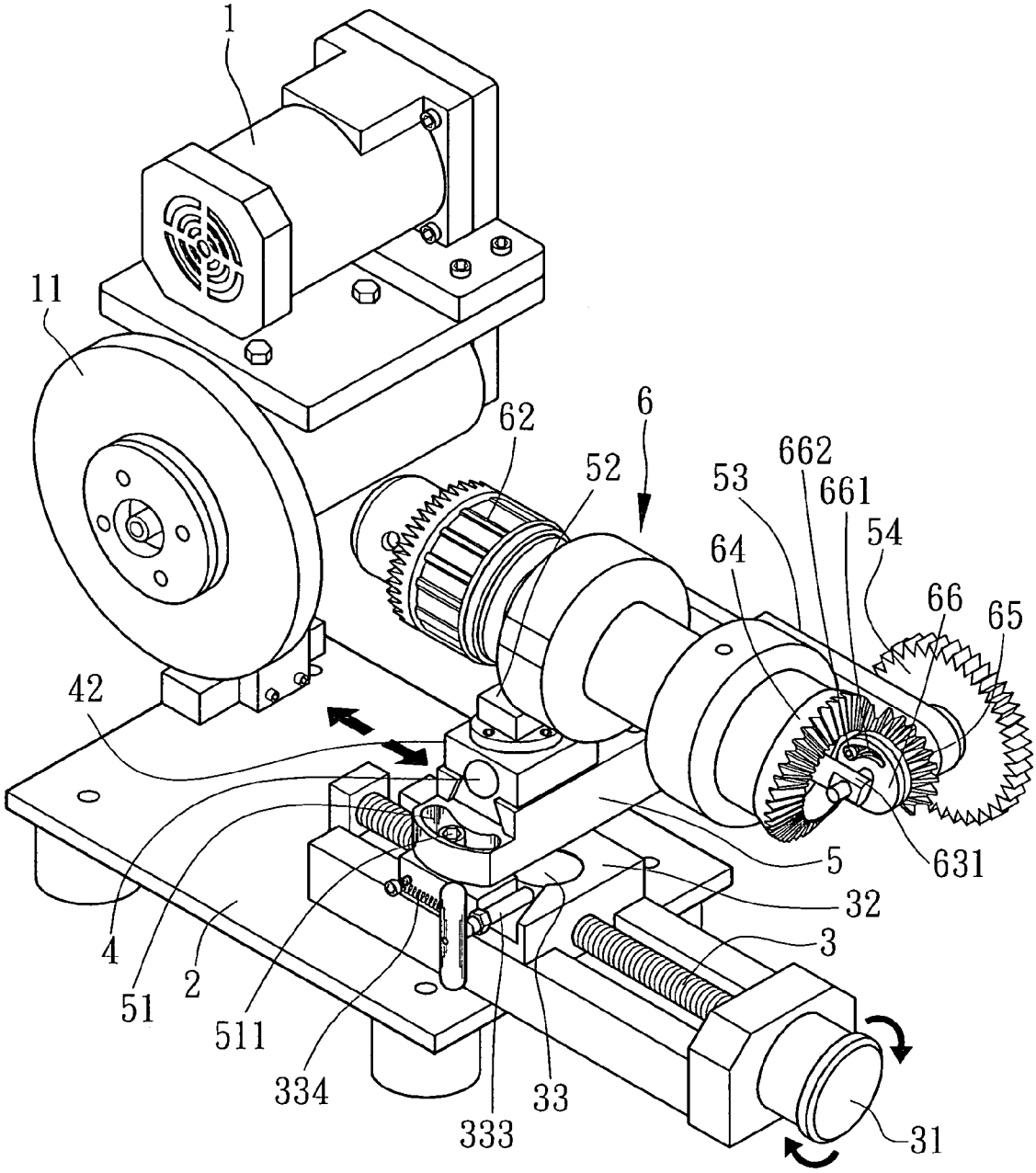
FIG. 1 is an exploded view of a grinding machine according to the present invention.
Figure 2:
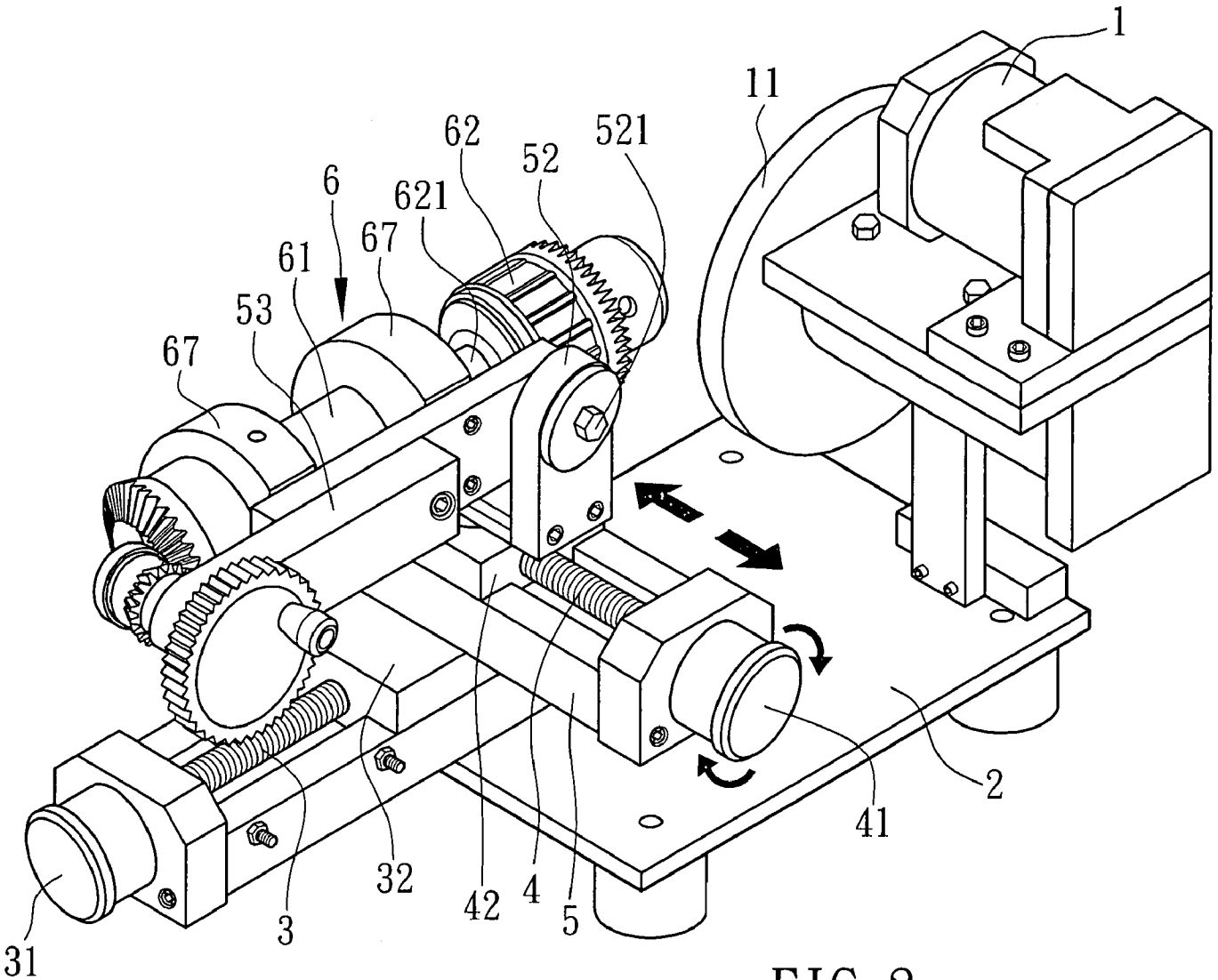
FIG. 2 is a schematic drawing showing the tool holder of the grinding machine adjusted in Y-axis direction according to the present invention.
Figure 3:
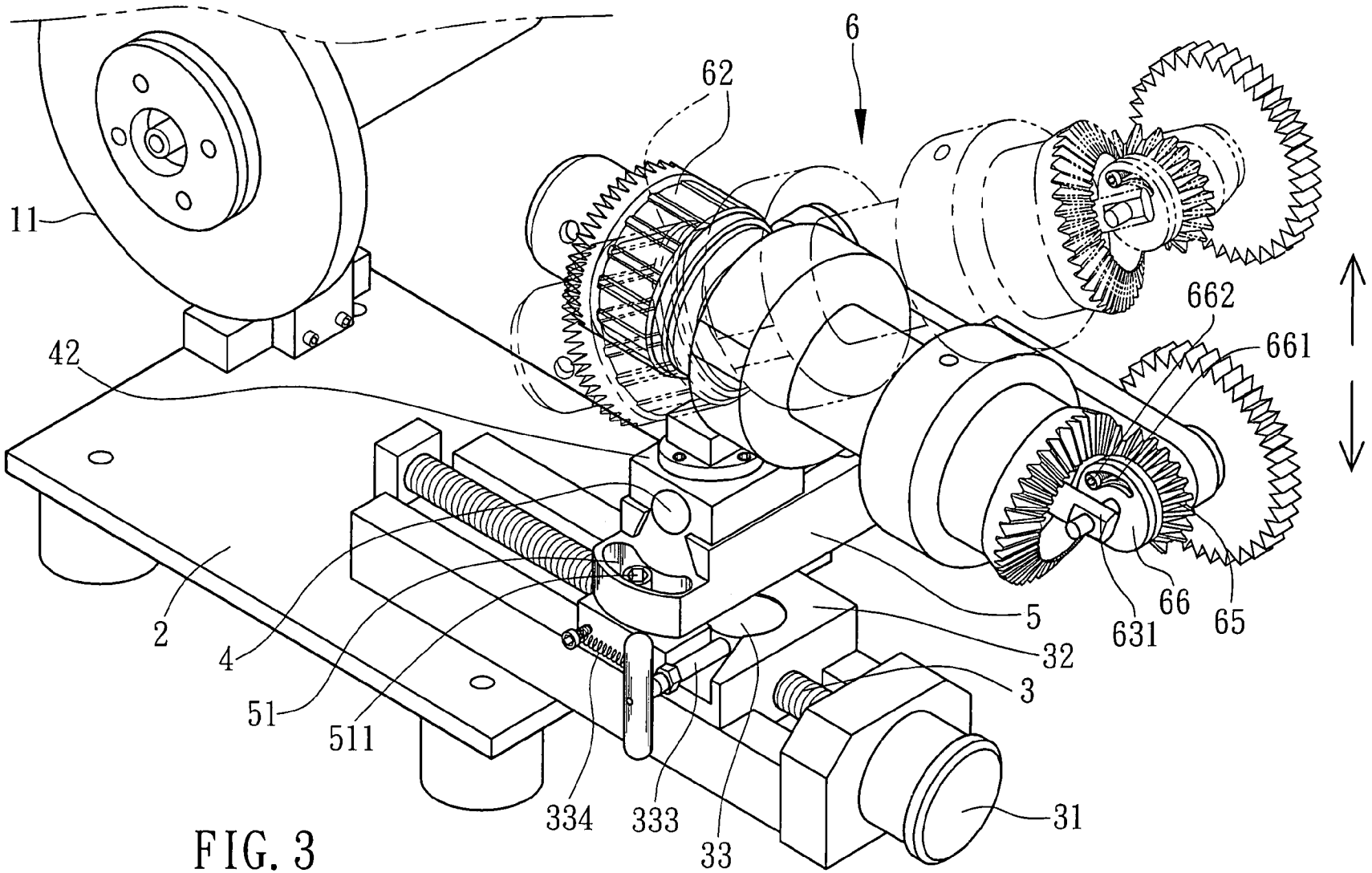
FIG. 3 is a schematic drawing showing adjustment of the tilting angle of the tool holder of the grinding machine according to the present invention.
Figure 4:
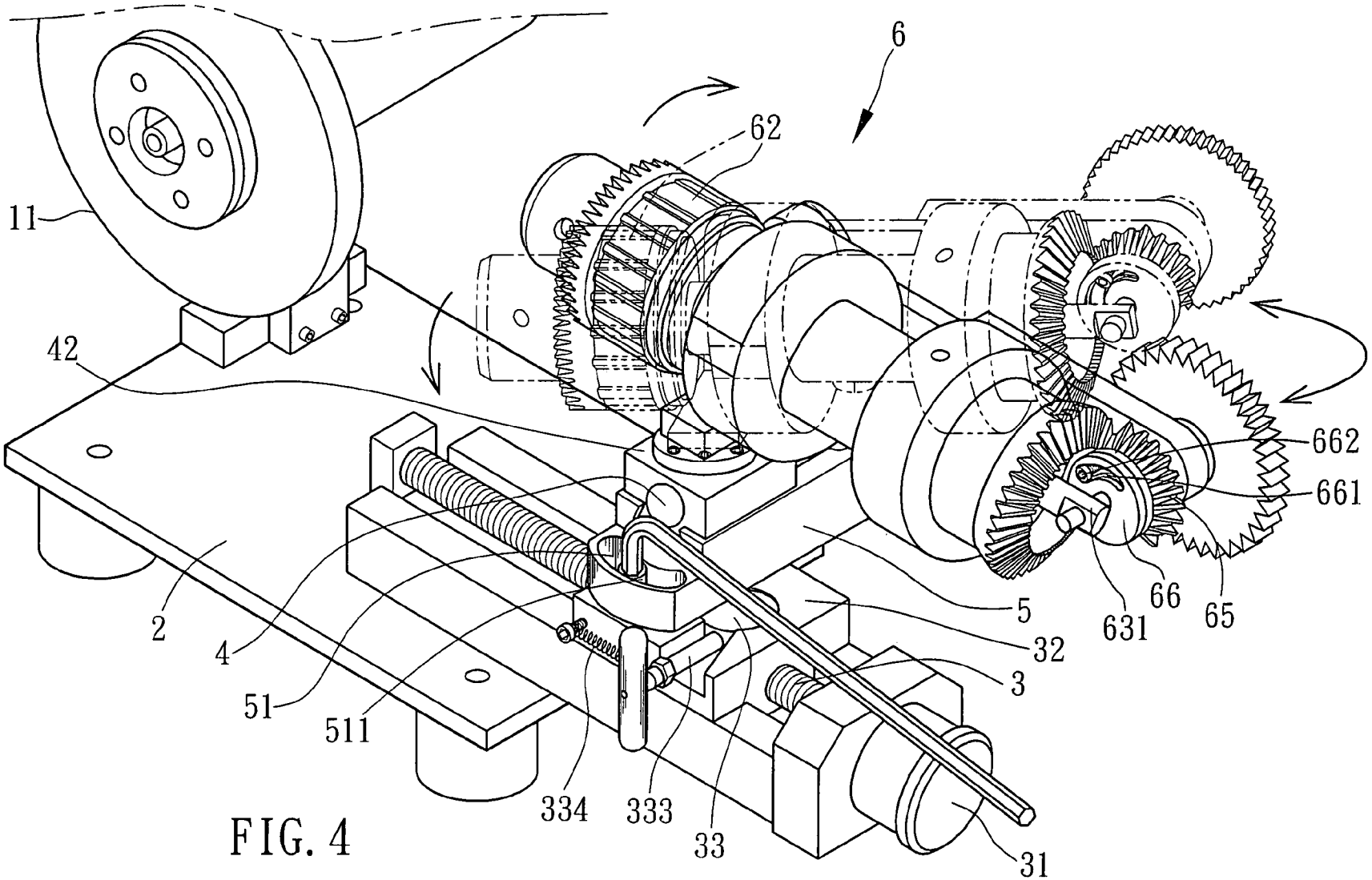
FIG. 4 is a schematic drawing showing adjustment of horizontal angle of the tool holder of the grinding machine according to the present invention.
Figure 5:
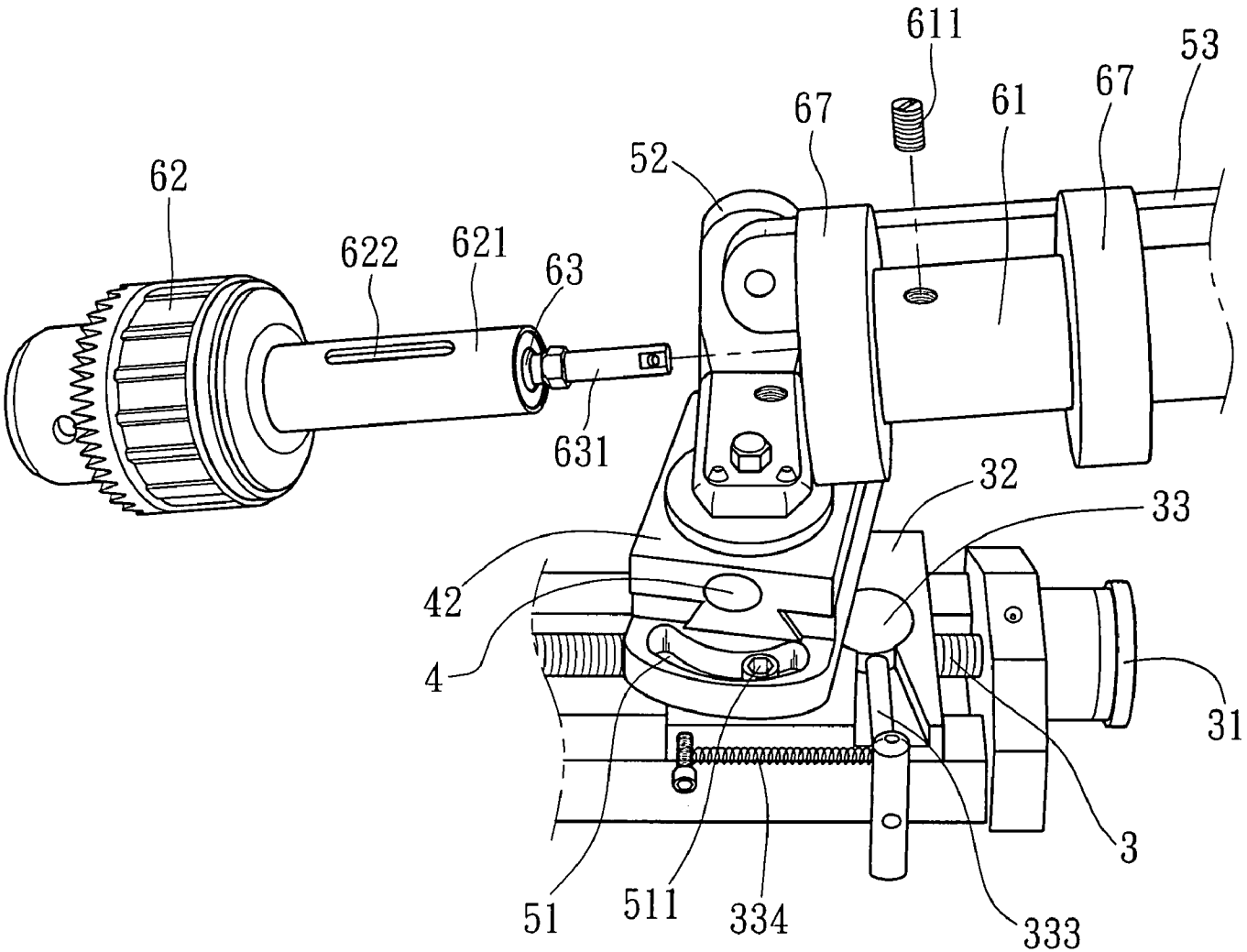
FIG. 5 is an exploded view of a part of the present invention, showing the structure of the tool holder.
Figure 6:
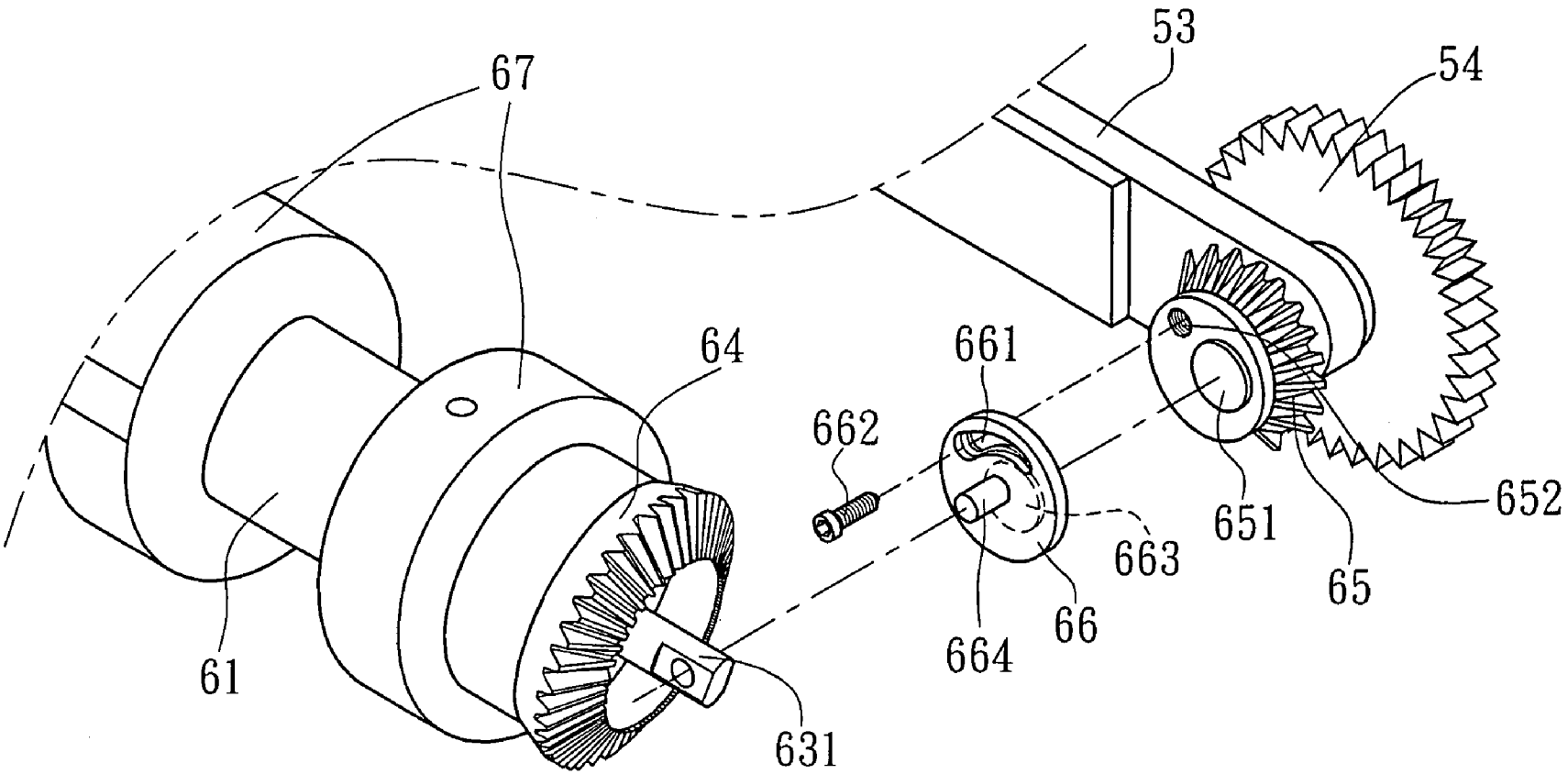
FIG. 6 is an exploded view of a part of the present invention, showing the relative positioning between the rear side of the tool holder and the drive bevel gear.
Figure 7:
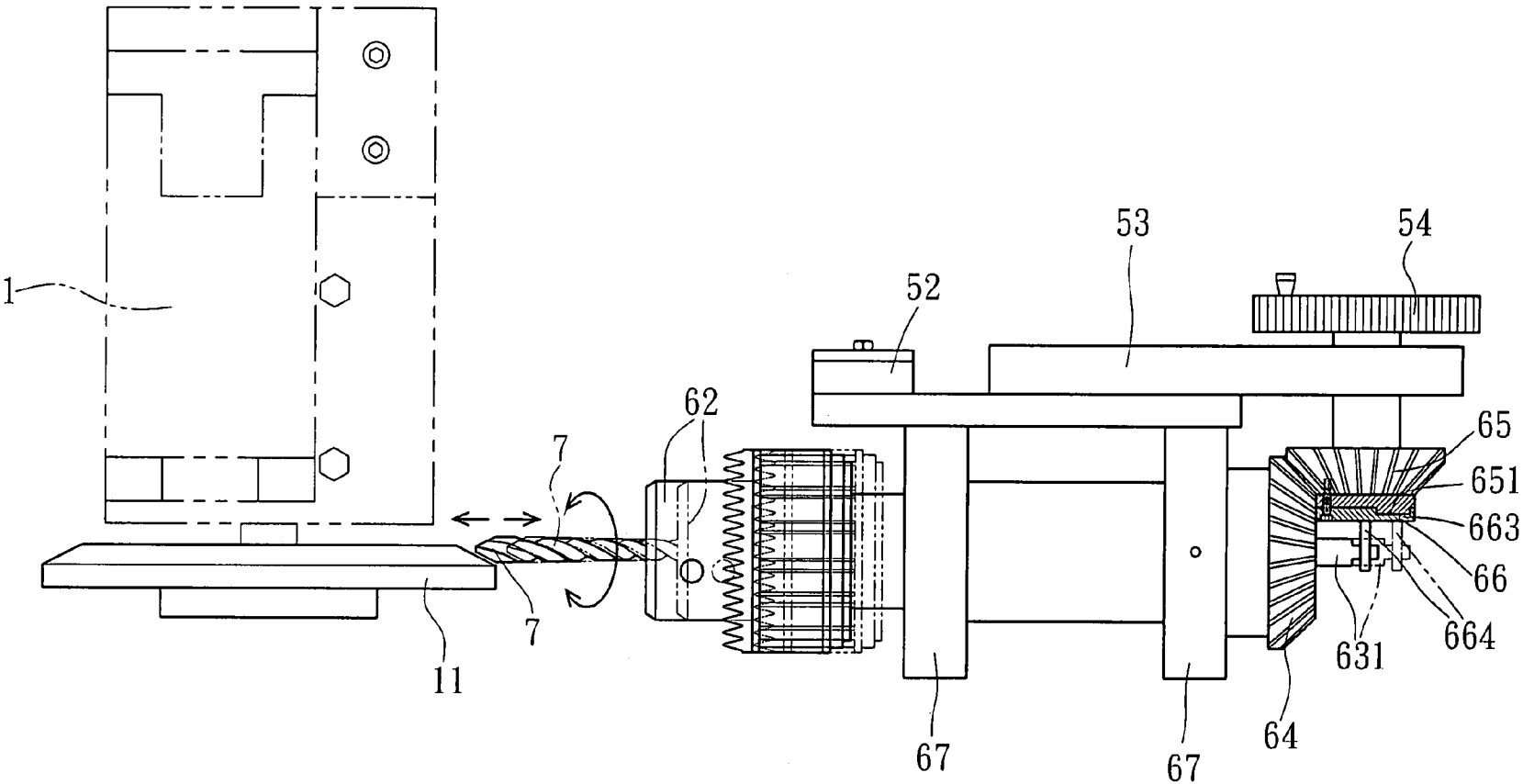
FIG. 7 is a schematic side view of the present invention, showing the chuck rotated and reciprocated.

Referring to FIGS. 1 and 2, a grinding machine comprises a grinding unit, a workpiece driving unit, and a machine base 3 supporting the grinding unit and the workpiece driving unit. The grinding unit comprises a motor 1 fixedly mounted on the machine base 2, and a grinding wheel 11 coupled to and rotatable by the motor 1. The workpiece driving unit comprises a first guide screw 3 pivotally mounted on the machine base 2 at the top side in horizontal and extending in X-axis direction, a first slide 32 coupled to the first guide screw 3 and movable forwards/backwards in X-axis direction upon rotation of the first guide screw 3 in clockwise/counter-clockwise direction, a locating block 5 mounted on the first slide 32, a second guide screw 4 pivotally mounted in the locating block 5 and extending in Y-axis direction in parallel to the center axis of the grinding wheel 11, a second slide 42 coupled to the second guide screw 4 and movable forwards/backwards in Y-axis direction upon rotation of the second guide screw 4 in clockwise/counter-clockwise direction, a first knob 31 fixedly fastened to one end of the first guide screw 3 for operation by the user to rotate the first guide screw 3, a second knob 41 fixedly fastened to one end of the second guide screw 4 for operation by the user to rotate the second guide screw 4, a rack 52 horizontally rotatably mounted on the second slide 42 (see FIG. 4), a bracket 53 pivotally mounted on the rack 52 and locked thereto by a screw bolt 521 for allowing the bracket 53 to be turned about Y-axis after loosened the screw bolt 521 (see FIG. 3), an axle sleeve 67 fixedly mounted on the bracket 53, and a tool holder 6 mounted in the axle sleeve 67. The tool holder 6 comprises a barrel 61 mounted in the axle sleeve 67, a shaft 621, and a chuck 62 mounted on one end of the shaft 621. A screw 611 is mounted in the barrel 61 and threaded into a longitudinal groove 622 at the periphery of the shaft 621 to secure the shaft 621 to the barrel 61 (see FIG. 5), allowing axial movement of the shaft 621 relative to the barrel 61 and rotary motion with the barrel 61. The tool holder 6 further comprises a driven bevel gear 64 fixedly mounted on the rear end of the barrel 61 and meshed with a drive bevel gear 65, which is pivotally mounted on the bracket 53 and rotatable by a hand wheel 54 (or belt wheel). A universal joint 63 is pivotally mounted in one end of the shaft 621 to support an extension axle 631. The drive bevel gear 65 has an eccentric rod 651 perpendicularly extending from the front side thereof, and a screw hole 652 on the front side near the periphery. An eccentric wheel 66 is coupled between the extension axle 631 and the drive bevel gear 65. The eccentric wheel 66 comprises a recessed coupling hole 663 disposed at the back side at an eccentric location and coupled to the eccentric rod 651, a front coupling rod 664 perpendicularly extending from the front side and coupled to the extension axle 631, and an arched sliding slot 661 cut through the front and back side near the periphery. A lock screw 662 is inserted through the arched sliding slot 661 and threaded into the screw hole 652 to adjustably lock the eccentric wheel 66 to the drive bevel gear 65 at the desired angle. When operating the hand wheel 54 to drive the drive bevel gear 65 to rotate the driven bevel gear 64 and the barrel 61, the shaft 621 and the chuck 62 are simultaneously rotated with the barrel 61, and at the same time the eccentric wheel 66 is alternatively rotated forwards and backwards to reciprocate the extension axle 631 and the shaft 621 with the chuck 62 (see FIGS. 6 and 7). By means of changing the angular position of the eccentric wheel 66 relative to the drive bevel gear 65, the reciprocating distance and cycle of the extension axle 631 is relatively changed. After installation of the workpiece (milling cutter or tool bit) 7 in the chuck 62, the first guide screw 3 and the second guide screw 4 are rotated to adjust the position of the first slide 32 and the second slide 42 in X-axis and Y-axis directions respectively. Thereafter, adjust the angular position of the bracket 53 so as to adjust the tilting angle of the chuck 62 and the workpiece 7. Further, the locating block 5 has an arched sliding slot 51 through which an adjustment screw 511 is inserted and threaded into the first slide 32 to lock the locating block 5 to the first slide 32. When the adjustment screw 511 is loosened, the locating block 5 can be turned horizontally to adjust the angle between the workpiece 7 and the outer edge of the grinding wheel 11.

Figure 9:
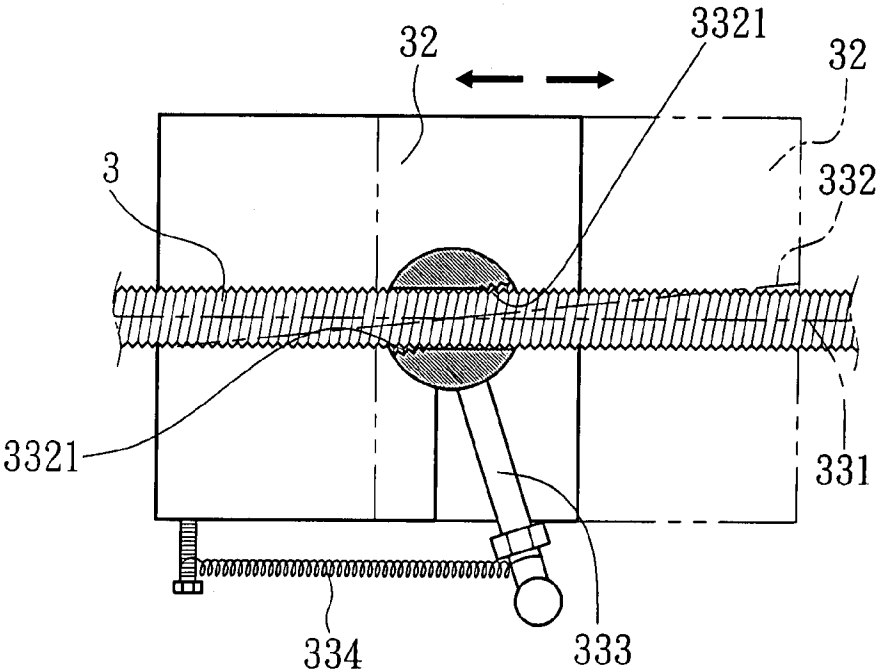
FIG. 9 corresponds to FIG. 8, showing the first guide screw disengaged from the locating block, the first slide adjusted relative to the first guide screw.
Figure 8:
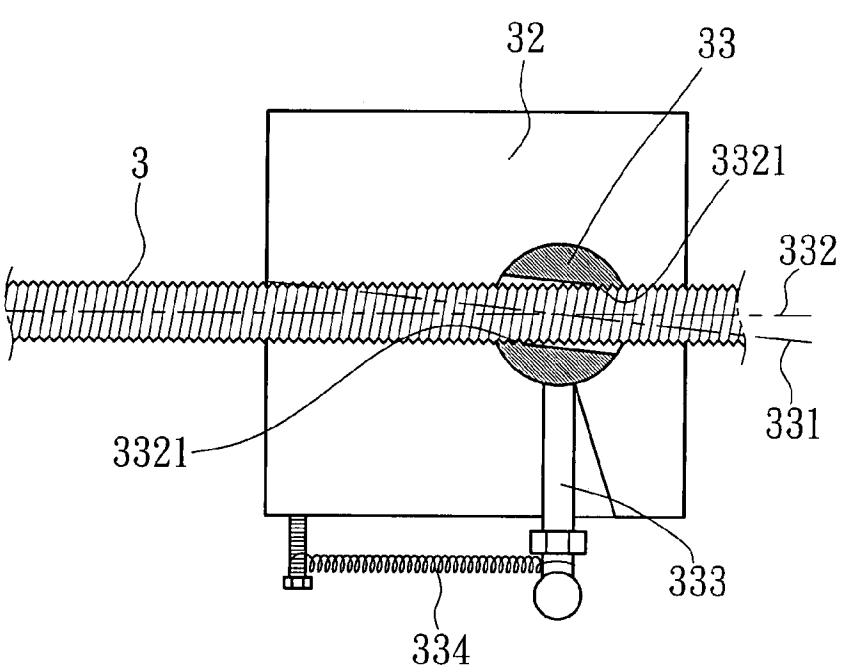
FIG. 8 is a schematic drawing showing the first guide screw meshed with the locating block according to the present invention.
Figure 10:
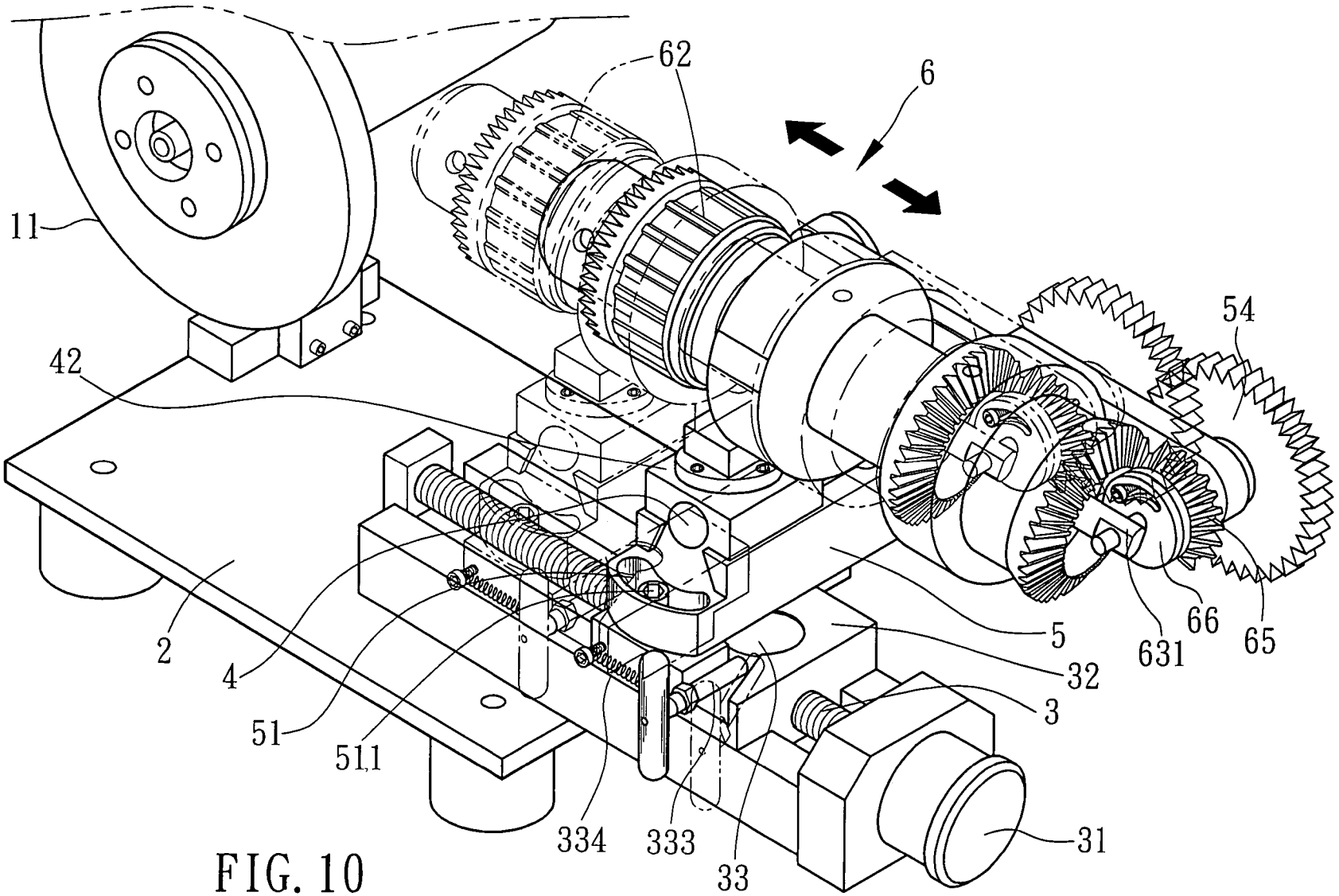
FIG. 10 is a schematic drawing of the present invention, showing the tool holder moved with the second slide and the first slide relative to the first guide screw.

Referring to FIGS. 8~10, an adjustment block 33 is mounted on the first slide 32, having an axial hole 332, an inner thread 3321 provided inside the axial hole 332 for engagement with the first guide screw 3, an adjustment hole 331 axially joining the axial hole 332 at an angle, a spring member 334 connected between the adjustment block 33 and the first slide 32 to hold the adjustment block 33 in an engagement position where the inner thread 3321 is kept meshed with the first guide screw 3 to prohibit movement of the first slide 32 relative to the first guide screw 3 when the first guide screw 3 stands still, and a handle 333 fastened to the adjustment block 33 for pulling by hand to move the adjustment hole 331 into a parallel position relative to the first guide screw 3 where the inner thread 3321 is disengaged from the first guide screw 3 for allowing quick position adjustment of the first slide 32 relative to the first guide screw 3.

Although particular embodiments of the invention have been described in detail for purposes of illustration, various modifications and enhancements may be made without departing from the spirit and scope of the invention.

What the invention claimed is:

1. A grinding machine comprising:

a machine base;

a grinding unit, said grinding unit comprising a motor fixedly mounted on said machine base and a grinding wheel coupled to and rotatable by said motor; and a workpiece driving unit, said workpiece driving unit comprising a first guide screw pivotally mounted on said machine base, a first slide coupled to said first guide screw and movable forwards/backwards in X-axis direction upon rotation of said first guide screw in clockwise/counter-clockwise direction, a locating block mounted on said first slide, a second guide screw pivotally mounted in said locating block and extending in Y-axis direction in parallel to the center axis of said grinding wheel, a second slide coupled to said second guide screw and movable forwards/backwards in Y-axis direction upon rotation of said second guide screw in clockwise/counter-clockwise direction, a first knob fixedly fastened to one end of said first guide screw for operation by the user to rotate said first guide screw, a second knob fixedly fastened to one end of said second guide screw for operation by the user to rotate said second guide screw, a rack horizontally rotatably mounted on said second slide, a bracket pivotally mounted on said rack and locked thereto by a screw bolt for allowing said bracket to be turned about Y-axis after loosened said screw bolt, an axle sleeve fixedly mounted on said bracket, and a tool holder mounted in said axle sleeve, said tool holder comprising a barrel mounted in said axle sleeve, a shaft, said shaft having a longitudinal groove on the periphery thereof, a chuck mounted on one end of said shaft, a screw mounted in said barrel and threaded into the longitudinal groove of said shaft to secure said shaft to said barrel for allowing axial movement of said shaft relative to said barrel and rotary motion of said shaft with said barrel, a drive bevel gear pivotally mounted on said bracket, a driven bevel gear fixedly mounted on a rear end of said barrel and meshed with said drive bevel gear, a hand wheel for rotating said drive bevel gear, an universal joint pivotally mounted in one end of said shaft, an extension axle mounted in said universal joint, and an eccentric wheel coupled between said driven bevel gear and said extension axle such that when operating said hand wheel to drive said drive bevel gear to rotate said driven bevel gear and said barrel, said shaft and said chuck are simultaneously rotated with said barrel, and at the same time said eccentric wheel is alternatively rotated forwards and backwards to reciprocate said extension axle, said shaft and said chuck.

2. The grinding machine as claimed in claim 1, wherein said drive bevel gear has a front side, and an eccentric rod perpendicularly extending from the front side; said eccentric wheel comprises a recessed coupling hole disposed at a back side thereof at an eccentric location and coupled to said eccentric rod of said driven bevel gear, and a front coupling rod perpendicularly extending from a front side thereof and coupled to said extension axle.

3. The grinding machine as claimed in claim 2, wherein said drive bevel gear comprises a screw hole at the front side near the periphery thereof; said eccentric wheel further comprises an arched sliding slot cut through front and back sides thereof, and a lock screw inserted through said arched sliding slot and threaded into the screw hole of said drive bevel gear to adjustably lock said eccentric wheel to said drive bevel gear.

4. The grinding machine as claimed in claim 1, wherein said workpiece driving unit further comprises an adjustment block mounted on said first slide, said adjustment block having an axial hole, an inner thread provided inside said axial hole for engagement with said first guide screw, an adjustment hole axially joining said axial hole at an angle, a spring member connected between said adjustment block and said first slide to hold said adjustment block in an engagement position where said inner thread is kept meshed with said first guide screw to prohibit movement of said first slide relative to said first guide screw when said first guide screw stands still, and a handle fastened to said adjustment block for pulling by hand to move said adjustment hole into a parallel position relative to said first guide screw where said inner thread is disengaged from said first guide screw for allowing quick position adjustment of said first slide relative to said first guide screw.

* * * * *